United States Patent [19]

Karlsson

[11] 4,137,644

[45] Feb. 6, 1979

[54] TREATING AIRBORNE WEB MATERIAL

[75] Inventor: Ingemar Karlsson, Växjö, Sweden

[73] Assignee: Aktiebolaget Svenska Flaktfabriken, Nacka, Sweden

[21] Appl. No.: 746,093

[22] Filed: Nov. 30, 1976

[30] Foreign Application Priority Data

Dec. 9, 1975 [SE] Sweden ..... 7513864

[51] Int. Cl.[2] ..... F26B 13/20

[52] U.S. Cl. ..... 34/23; 34/156; 226/7; 226/97; 302/31

[58] Field of Search ..... 302/29, 31; 226/7, 97; 34/156, 10, 155, 23, 24

[56] References Cited

U.S. PATENT DOCUMENTS

| | | | |
|---|---|---|---|
| 3,231,165 | 1/1966 | Wallin et al. | 302/29 |
| 3,622,058 | 11/1971 | Vits | 226/97 |
| 3,957,187 | 5/1976 | Puigrodon | 34/156 |

*Primary Examiner*—John J. Camby
*Assistant Examiner*—Larry I. Schwartz
*Attorney, Agent, or Firm*—Dorfman, Herrell and Skillman

[57] ABSTRACT

Web material is carried on air to advance the material in a fixed stable floating position through one or more decks of a treating plant, preferably a drier. The air is supplied through pairs of apertures arranged in the upper surface of blow-boxes distributed in the conveying path of the material which apertures eject the air in pairs of streams facing away from each other. To reduce deflection of the material between said pair of apertures the space between said apertures is supplied separately with a great volume of secondary air of the same static pressure as that prevailing on the upper surface of the material, which secondary air is taken along by ejector effect by the primary air streams ejected from the apertures of the blow-boxes.

7 Claims, 6 Drawing Figures

TREATING AIRBORNE WEB MATERIAL

Figure 1:
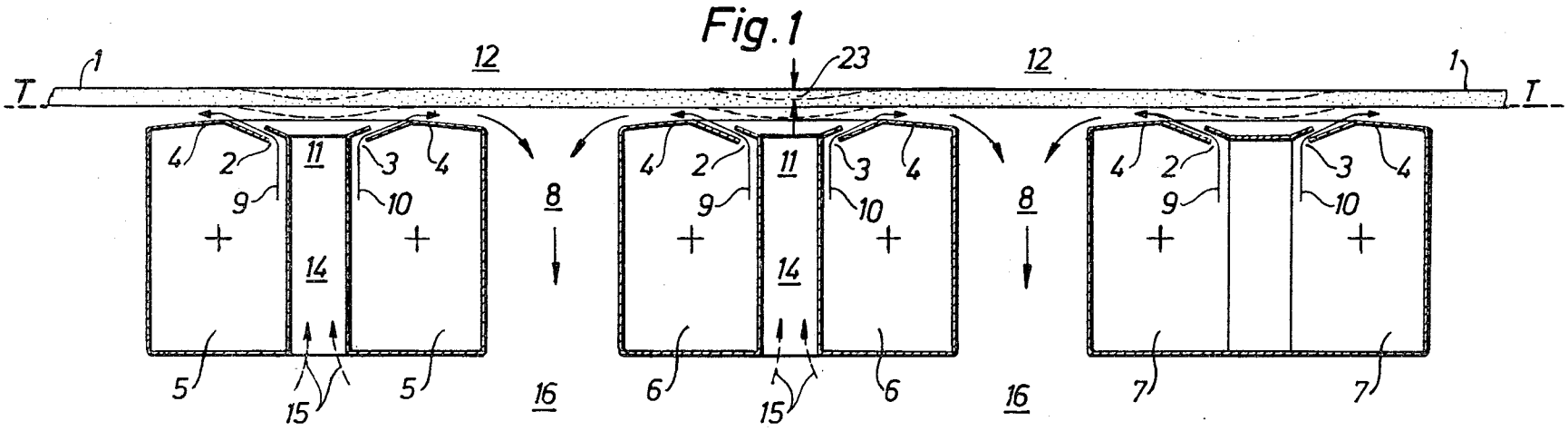

This invention relates to a method and a device in order in an installation for treating airborne web material passing through the installation, to which the air is supplied through pairs of apertures arranged in the upper surface of blow-boxes distributed in the conveying path of the material, to reduce the deflection of the material over said blow-boxes, in which said apertures are designed to eject the air in pairs of streams facing away from each other, whereby in the space between said apertures a static underpressure in relation to the pressure on the upper surface of the material tends to arise and to cause said deflection.

The present invention has the object at installations of the aforesaid kind to reduce the differences in the intended floating distance from a web material adjacent a blow-box and to establish stabilization of the floating distance even in the case of varying web material weights per square meter. It has been tried previously, as illustrated a.o. in FIG. 2 of the Swedish patent specification No. 320 321, (U.S. Pat. No. 3,231,165) to overcome this problem by blowing air perpendicularly against the web. This requires, however, a greater demand for air effect from the treatment installation and also an accurate and tedious adjusting of said air, which has proved troublesome, particularly at varying web weights and web tensions. The disadvantages then are that between the material web and the blow-box plane contact can be established, and the web can be caused to flatter. This latter risk is particularly great when an easy-flexible web, for example paper, is to be treated.

The method according to the invention is characterized thereby that the space between the apertures is supplied with a great volume of air (secondary air) having substantially the same static pressure as that prevailing on the upper surface of the material, which secondary air is taken along by ejector effect by the primary air streams ejected from the apertures of the blow-boxes.

A device for carrying out the method according to the invention is characterized primarily by passages or pipes for sucking in secondary air, which are mounted in each blow-box and extend transversely therethrough and open between said ejection apertures for the primary air. An advantageous embodiment of such a device is characterized in that in said passages or pipes special ejector apertures are provided, which are designed to eject primary air from the blow-box in the flow direction of the secondary air, thereby compensating for the pressure drop in the passages or pipes. Said passages and pipes may be designed so as to communicate with the ambient and, thus, be capable to suck in air of atmospheric pressure or, according to a preferred embodiment, the device may be so designed that said passages and pipes communicate with a space, which includes a greater or smaller part of the blow-box and is separated from the ambient (zero pressure space), in which space the pressure is substantially the same as on the upper surface of the web, and which is supplied with air by returning a part of the primary air, which was collected in the form of spent air after its passage between the material web and the blow-box. According to further characterizing features of embodiments of the device as they are apparent from the accompanying drawings, means for separation of return air may be attached to both sides of the blow-box or only to one side thereof.

Figure 1A:
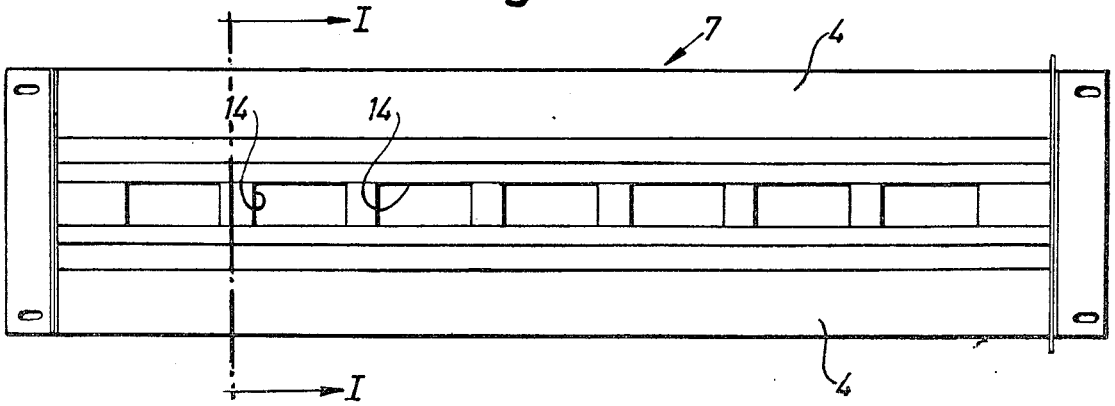
Figure 2:
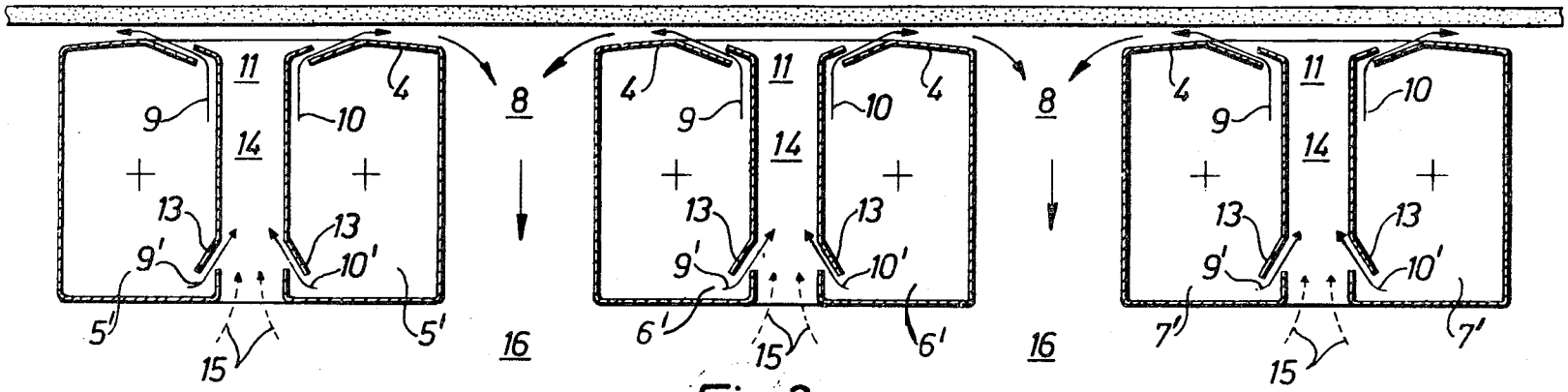
Figure 3:
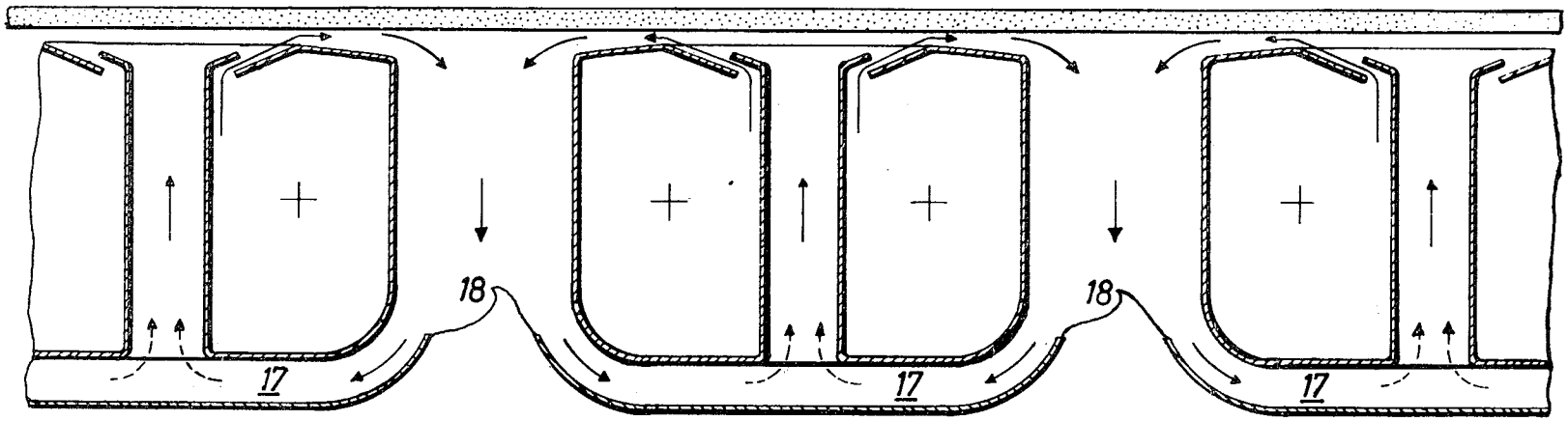
Figure 4:
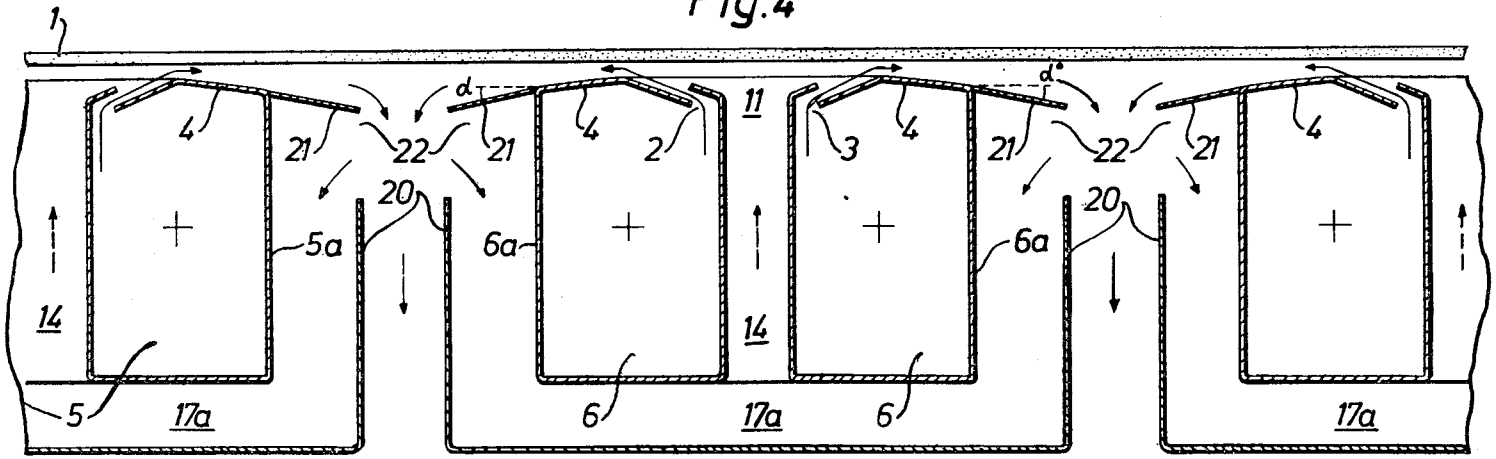
Figure 5:
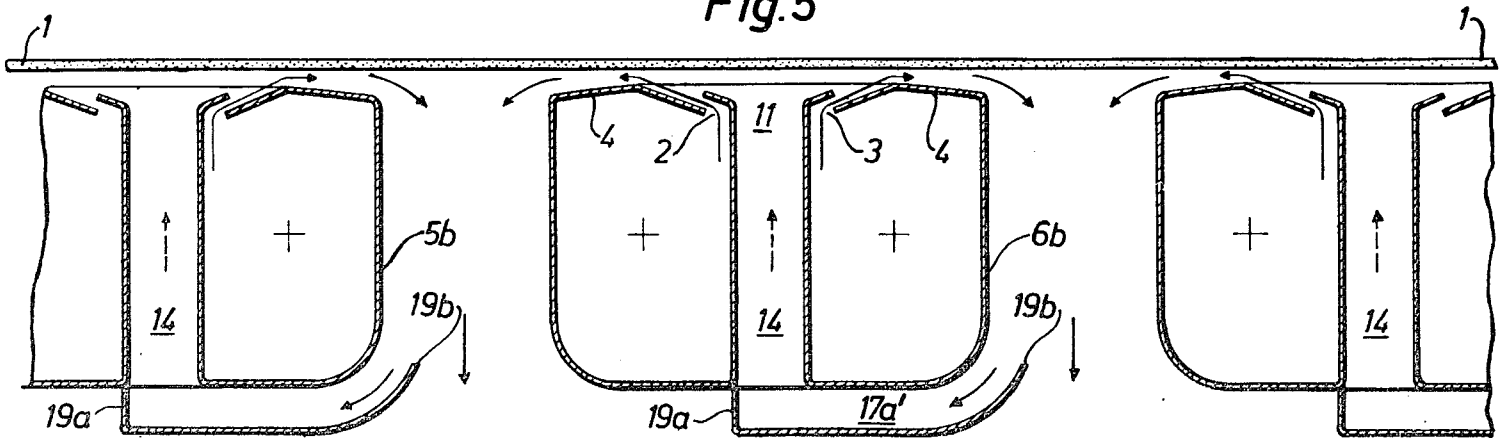

The invention is described in greater detail in the following, with reference to the accompanying drawings, in which FIG. 1 is a cross-section through the basic design of the device with blow-boxes according to the invention, the righthand blow-box being shown by way of a section along the line I—I in FIG. 1A, FIG. 1A is a horizontal view of the upper surface of a blow-box, FIG. 2 is a cross-section through the device in a blow-box provided with separate ejector apertures adjacent the inlet to the space between apertures of the blow box, FIG. 3 is a cross-section through the device where each blow-box is enclosed by a space separated from the ambient, FIG. 4 is a cross-section through a modified embodiment of the device, provided with means for separation of return air along both sides of the blow-box, FIG. 5 is a cross-section through the device, provided with means for separation of return air along one side of the blow-box.

In the Figures, 1 designates a web material, which is advanced airborne along a substantially horizontal conveying plane T—T. The numerals 2, 3 designate two apertures facing away from each other and arranged in pairs on the upper surface 4 of the blow-box 5, 6, 7, which upper surface has plane or slightly convex configuration. The perforation usually is of the so-called eyelid type, but also narrow coherent slots may be used for supplying this primary air. 8 designates draining apertures between the blow-boxes. At the embodiment shown of the device, the blow-boxes are attached perpendicularly to the conveying path of the web material, but the invention also covers the case that a plurality of blow-boxes are oriented in longitudinal direction one after the other along the conveying path of the web. The upper surface 4 of the blow-boxes has a slightly convex configuration, i.e. a curvature with a very great radius. Each blow-box is supplied from fans (not shown) with air of overpressure indicated +, which is caused to flow out in the directions 9 and 10 at high speed. In the space between the material 1 and the upper surface 4 of the blow-box the air jet immediately after its supply will flow in parallel between these two surfaces, which implies that in the passage, due to the hydrodynamic effect, also called Coanda effect, a force arises which draws the surfaces toward each other until the distance between them is so small that the static pressure drop for the flow keeps balance with said force. It was found, however, that underpressure arises in the space between the blow-on apertures 2, 3, which space here is designated by 11. Owing to this underpressure and the weight of the web, an undesired deflection 23 is brought about. 12 designates the pressure on the upper surface of the material web. 14 designates passages or pipes for sucking in secondary air designated by 15. The passages (pipes) are mounted in each blow-box and extend transversely therethrough from its bottom side to its upper surface 4 where the passages open into the space 11 between the aforesaid ejection apertures 2 and 3, respectively, for blowing-on the primary air streams 9 and 10, respectively. As shown in the drawing, the opening at the upper end of the passage 14 is substantially greater than the areas of the blow-on or ejector apertures 2, 3 to supply a great volume of air (secondary air). The said passages may communicate at the other end with the ambient 16 in order to suck in air of atmospheric pressure. See FIGS. 1 and 2. In FIG. 2 the numeral 13 designates secondary ejector apertures in the blow-boxes 5', 6' and 7', respectively which are disposed angularly to eject primary air in the flow direction of the secondary air flow. The numerals 9' and 10' designate the ejector air streams. At the further developed embodiments of the device according to the invention — see FIGS. 3, 4 5 — the passages (pipes) instead communicate with a space 17, 17*a* and 17*a'*, respectively, including a greater or smaller part of the blow-box. This space (zero pressure space) has substantially the same pressure as on the upper surface 12 of the material. The space 17, 17*a* and 17*a'*, respectively, is supplied with air by returning a part of the primary air 9 and 10, respectively, which in the form of spent air has been collected after its passage between the material web 1 and the upper surface 4 of the blow-box. In FIG. 3 the numeral 18 designates means for the separation of return air. These means are attached on both sides of the blow-box. In FIG. 4 corresponding means are designated by 20. At this modified embodiment shown in FIG. 4 the upper surface 4 of the blow-box is extended by a downward folded portion 21. The angle $\alpha$ is presupposed to be of the magnitude 15°–45°, depending a.o. on the ejection speed. Between the means 20 and said extended blow-box portion 21 an aperture 22 is provided for sucking in return air, which in the passages 14 is supplied as secondary air to the aforesaid space 11. At the illustrated blow-boxes 5 and 6, the sides are designated 5*a*, 5*b* and 6*a*, 6*b*, respectively. In FIG. 5 the blow-boxes 5 and 6 are enclosed by a means 19*a*–19*b* extending only from one side 5*b* and 6*b*, respectively, of the blow-box all the way to the passage 14.

The blow-boxes in their design according to FIGS. 1, 2, 3 and 5 may advantageously be used in zigzag positions, as for example according to the U.S. Pat. No. 3,982,328, (Swedish patent application No. 7407119-2). They may also be used in zigzag positions without being combined with blow-boxes for perpendicular flow direction.

I claim:

1. A method for treating airborne web material passing through an installation where air is supplied at elevated pressure through pairs of spaced apertures arranged in the upper surface of blow-boxes disposed along the conveying path of the material, which apertures have openings which are designed to eject the air in pairs of streams facing away from each other and along the path of travel of the web, whereby in the space between said apertures a static underpressure in relation to the pressure on the upper surface of the material tends to arise and to cause deflection of the material, said method reducing said deflection and comprising separately supplying to said space between the apertures a great volume of secondary air having substantially the same static pressure as that prevailing on the upper surface of the material, which secondary air is taken along by ejector effect by the primary air streams ejected from the apertures of the blow-boxes, said space for supplying secondary air being substantially greater than the total flow area of said aperture openings so that said secondary air is supplied through said space between said apertures without substantial restriction, to maintain said same static pressure.

2. An installation for treating airborne web material passing through the installation, comprising blow boxes for supplying air at an elevated pressure relative to the pressure on the upper surface of the web, said blow boxes including:

pairs of spaced apertures arranged in upper surfaces of the blow boxes along the conveying path of the material for supplying primary air to said web, said apertures being designed to eject the primary air in pairs of streams facing away from each other and along the conveying path of the web, whereby in the space between said apertures a static underpressure in relation to the pressure on the upper surface of the material tends to arise and to cause deflection and;

passages or pipes mounted in each blow-box and extending transversely therethrough and open at one end toward said conveying path between said ejection apertures for the primary air for sucking in a great volume of secondary air having substantially the same static pressure as that prevailing on the upper surface of the material, whereby said secondary air is taken along by ejector effect by the primary air streams ejected from said apertures, the area of said opening at said one end being substantially greater than the areas of the ejector apertures to afford variation in the volume of secondary airflow without substantially affecting its static pressure.

3. A device according to claim 2, including special ejector apertures in said passages or pipes having angular openings to eject primary air at elevated pressure from the blow-box into said passages or pipes upstream of said one end in the flow direction of the secondary air, thereby compensating for the pressure drop in the passages or pipes and maintaining said same static pressure at said one end.

4. A device according to claim 2 characterized in that passages or pipes communicate with a zero pressure space in a part of the blow-box which is separated from the ambient and has substantially the same pressure as on the upper surface of the material, and means to supply said space with air by returning a part of the primary air from between the material and the blow-box.

5. A device according to claim 4, characterized in that said means for returning air is disposed on both sides of the blow-box.

6. A device according to claim 4, characterized in that said means for returning air is disposed on only one side of the blow-box.

7. In an installation for treating airborne web material passing through the installation, having blow boxes where the air is supplied through pairs of primary apertures arranged in upwardly-facing surfaces along the conveying path of the material, which apertures are designated to eject the air in pairs of streams facing away from each other, whereby in the space between said primary apertures a static underpressure in relation to the pressure on the upper surface of the material tends to arise and to cause deflection, characterized in that passages or pipes for sucking in a great volume of secondary air having substantially the same static pressure as that prevailing on the upper surface of the material, are mounted in each blow-box and extend transversely therethrough and open at one end toward said conveying path between said ejection apertures for the primary air and open at the opposite end directly with ambient air to suck in atmospheric air, whereby said secondary ambient air is taken along by ejector effect by the primary air streams ejected from said apertures, said blow-box including special secondary ejector apertures opening into said passages or pipes between said one end and said opposite end to eject air from the blow-box into said passages or pipes in the flow direction of the secondary ambient air, thereby compensating for the pressure drop in the passages or pipes and maintaining said same static pressure at said one end.

* * * * *